US007799149B2

(12) United States Patent
Ohe et al.

(10) Patent No.: US 7,799,149 B2
(45) Date of Patent: Sep. 21, 2010

(54) OIL COUNTRY TUBULAR GOOD FOR EXPANSION IN WELL AND MANUFACTURING METHOD THEREOF

(75) Inventors: Taro Ohe, Osaka (JP); Keiichi Nakamura, Osaka (JP); Hideki Takabe, Osaka (JP); Toshiharu Abe, Osaka (JP); Tomoki Mori, Osaka (JP); Masakatsu Ueda, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 12/285,031

(22) Filed: Sep. 29, 2008

(65) Prior Publication Data

US 2009/0032150 A1 Feb. 5, 2009

Related U.S. Application Data

(63) Continuation of application No. PCT/JP2008/054746, filed on Mar. 14, 2008.

(30) Foreign Application Priority Data

Mar. 30, 2007 (JP) ..... 2007-090639
Jul. 26, 2007 (JP) ..... 2007-194695

(51) Int. Cl.
*C22C 38/04* (2006.01)
*C22C 38/18* (2006.01)
*C21D 8/10* (2006.01)
*C21D 9/08* (2006.01)

(52) U.S. Cl. ..... 148/335; 148/519; 148/590; 148/593; 148/650; 148/663; 148/909

(58) Field of Classification Search ..... 148/320, 148/333–335, 519, 590, 593, 652, 909, 650, 148/663
See application file for complete search history.

(56) References Cited

U.S. PATENT DOCUMENTS 4,345,952 A * 8/1982 Royer et al. ..... 148/539

(Continued)

FOREIGN PATENT DOCUMENTS

EP 0 733 715 9/1996

(Continued)

OTHER PUBLICATIONS

Material Properties, Formability Testing of Sheet Metals, Metalworking: Sheet Forming, vol. 14B, ASM Handbook, ASM International, 2006, pp. 673-696. http://products.asminternational.org.*

*Primary Examiner*—Deborah Yee
(74) *Attorney, Agent, or Firm*—Clark & Brody

(57) ABSTRACT

An oil country tubular good for expansion according to the invention is expanded in a well. The oil country tubular good for expansion has a composition containing, in percentage by mass, 0.05% to 0.08% C, at most 0.50% Si, 0.80% to 1.30% Mn, at most 0.030% P, at most 0.020% S, 0.08% to 0.50% Cr, at most 0.01% N, 0.005% to 0.06% Al, at most 0.05% Ti, at most 0.50% Cu, and at most 0.50% Ni, and the balance consisting of Fe and impurities, and a structure having a ferrite ratio of at least 80%. The oil country tubular good for expansion has a yield strength in the range from 276 MPa to 379 MPa and a uniform elongation of at least 16%. Therefore, the oil country tubular good according to the invention has a high pipe expansion characteristic.

12 Claims, 1 Drawing Sheet

U.S. PATENT DOCUMENTS

| | | | | |
|---|---|---|---|---|
| 4,354,882 | A | 10/1982 | Greer | |
| 5,993,570 | A * | 11/1999 | Gray | 148/320 |
| 6,331,216 | B1 * | 12/2001 | Toyooka et al. | 148/320 |
| 6,723,453 | B2 * | 4/2004 | Toyooka et al. | 428/683 |
| 2003/0145920 | A1 * | 8/2003 | Kami et al. | 148/651 |
| 2004/0035576 | A1 | 2/2004 | Arai et al. | |
| 2005/0217768 | A1 | 10/2005 | Asahi et al. | |
| 2007/0116975 | A1 | 5/2007 | Yamazaki et al. | |
| 2007/0199720 | A1 | 8/2007 | Arai et al. | |

FOREIGN PATENT DOCUMENTS

| | | |
|---|---|---|
| EP | 1 717 331 | 11/2006 |
| JP | 58-157948 | 9/1983 |
| JP | 59-25927 | 2/1984 |
| JP | 62-10240 | 1/1987 |
| JP | 62-10241 | 1/1987 |
| JP | 5-255794 | 10/1993 |
| JP | 7-507610 | 8/1995 |
| JP | 09-287027 | 11/1997 |
| JP | 10-176239 | 6/1998 |
| JP | 2002-129283 | 5/2002 |
| JP | 2002-266055 | 9/2002 |
| JP | 2002-349177 | 12/2002 |
| JP | 2005-146414 | 6/2005 |
| JP | 2006-009078 | 1/2006 |
| WO | 93/25799 | 12/1993 |
| WO | 98/00626 | 1/1998 |
| WO | 2004/001076 | 12/2003 |
| WO | 2004/031420 | 4/2004 |
| WO | 2005/080621 | 9/2005 |

* cited by examiner

OIL COUNTRY TUBULAR GOOD FOR EXPANSION IN WELL AND MANUFACTURING METHOD THEREOF

This application is a continuation of International Patent Application No. PCT/JP2008/054746, filed Mar. 14, 2008.

TECHNICAL FIELD

The present invention relates to an oil country tubular good and a manufacturing method thereof, and more specifically, to an oil country tubular good to be expanded in a well and a manufacturing method thereof.

BACKGROUND ART

When a well (oil well or gas well) that yields oil or gas is constructed, a plurality of oil country tubular goods are inserted into the well. A conventional method of constructing a well is as follows. A well is drilled to a prescribed depth using a drill pipe, and then an oil country tubular good is inserted. Then, the well is further drilled and an oil country tubular good having a smaller outer diameter than the inner diameter of the previously inserted one is inserted. In this way, according to the conventional construction method, the outer diameters of oil country tubular goods to be inserted are sequentially reduced as the well is drilled deeper. Stated differently, as the oil well is deeper, the inner diameters of oil country tubular goods used in the upper part of the well (near the surface of the ground) increase. As a result, the drilling area increases, which pushes up the drilling cost.

A new technique for reducing the drilling area and thus reducing the drilling cost is disclosed by JP 7-507610 A and the pamphlet of International Publication WO 98/00626. The technique disclosed by these documents is as follows. An oil country tubular good having a smaller outer diameter than the inner diameter of an oil country tubular good provided in a well is inserted into the well. The oil country tubular good is inserted deeper beyond the already provided oil country tubular good and then expanded so that its inner diameter is equal to the inner diameter of the previously provided oil country tubular good. In short, the oil country tubular good is expanded inside the well. Therefore, even if the oil well is deep, it is not necessary to place oil country tubular goods having large diameters in the upper part of the well, which reduces the drilling area and the number of steel pipes as compared the conventional construction method.

Various studies have been conducted as to oil country tubular goods to be used in the above-described construction method (hereinafter as "oil country tubular goods for expansion"). The pamphlets of International Publication Nos. WO 2004/001076 and WO 2005/080621, and JP 2002-349177 A disclose oil country tubular goods for expansion that are directed to prevention of a decrease in the crushing strength after expansion. JP 2002-266055 A discloses an oil country tubular good directed to improvement of the corrosion resistance.

The oil country tubular good is expanded in a well and therefore must have a uniformly deforming characteristic when expanded (hereinafter referred to as "pipe expansion characteristic.") In order to obtain a high pipe expansion characteristic, the deforming characteristic without local constriction during working is required, in other words, uniform elongation that can be evaluated by tensile testing must be high. Herein, the "uniform elongation" means the distortion of a specimen (%) at the maximum load point during a tensile test. Particularly in the bell part where oil country tubular goods vertically placed on each other overlap, the tube expansion ratio is maximized. In consideration of the expansion ratio at the bell part, the uniform elongation of the oil country tubular good for expansion is preferably not less than 16%.

JP 2002-129283 A and JP 2005-146414 A disclose oil country tubular goods for expansion that are directed to improvement of the pipe expansion characteristic. In the disclosure of JP 2002-129283 A, the oil country tubular good is neither quenched nor tempered, and the structure of the steel includes 5% to 70% by volume of a ferrite phase and low temperature transformation phases such as a martensite phase, and a bainite phase. In this way, the oil country tubular good has a high pipe expansion characteristic.

However, if the ratio of the low temperature transformation phases such as the martensite phase and the bainite phase in the structure is large, high uniform elongation should not result.

The oil country tubular good disclosed by JP 2005-146414 A is subjected to well-known quenching and well-known tempering at a temperature less than Ac1 temperature and high pipe expansion characteristic results for the a yield ratio of at most 0.85 according to the disclosure. However, it has been found as a result of examinations that a uniform elongation of 16% or more does not result for the oil country tubular good disclosed by JP 2005-146414 A in some cases. Furthermore, the oil country tubular good disclosed by JP 2005-146414 A contains at least 1.45% Mn according to the description of the embodiment. Such a high Mn composition can degrade the toughness. The tempering temperature for the high Mn composition is high and therefore disadvantages such as decarbonizing and wearing of furnace walls can be encountered.

As disclosed by JP 2002-349177 A, an oil country tubular good for expansion preferably has high crushing strength against external pressure, i.e., high collapse strength. The collapse strength is affected by the ovality and the wall thickness eccentricity of the oil country tubular good. In order to obtain high collapse strength, it is preferable that the thickness deviation of the oil country tubular good is reduced, so that the wall thickness eccentricity is reduced, its cross section is approximated to a regular circle and thus the ovality is reduced.

DISCLOSURE OF THE INVENTION

It is an object of the present invention to provide an oil country tubular good for expansion having a high pipe expansion characteristic. More specifically, it is to provide an oil country tubular good for expansion having a uniform elongation of at least 16%.

The inventors have conducted various examinations and found as a result that in order to obtain high uniform elongation for a oil country tubular good for expansion, especially a uniform elongation as high as 16% or more, the following requirements (1) and (2) should be fulfilled.

(1) The ratio of ferrite in the metal structure is at least 80%. The ferrite phase is soft and therefore an increase in the ferrite ratio in the metal structure allows high uniform elongation to be obtained.

(2) The yield strength is adjusted in the range from 276 MPa to 379 MPa. In this way, necessary strength for an oil country tubular good is obtained and high uniform elongation results as well.

The inventors have also found that a uniform elongation of at least 18% for an oil country tubular good for expansion may be obtained by fulfilling the following requirement (3) in addition to (1) and (2) described above.

(3) Quenching and tempering are carried out and the tempering temperature is not less than Ac1 point. Herein, specific steps in the tempering processing are as follows. The temperature of an oil country tubular good for expansion after quenching is raised to a tempering temperature equal to or higher than Ac1 point. After raising the temperature, the tubular good is soaked for a prescribed period. After the soaking, the oil country tubular good for expansion is cooled by air. Through the processing, a high uniform elongation of 18% or more is obtained. Although the reason is not exactly known, it is probably because when the tempering temperature is set to at least as high as Ac1 point, an austenite phase precipitates during soaking and crystal grains in the steel are refined accordingly.

The inventors have also found that if a hollow shell is subjected to cold working before the quenching and tempering, the ovality and wall thickness eccentricity of the oil country tubular good for expansion can be reduced while the above-described uniform elongation is maintained, and therefore the collapse strength of the oil country tubular good for expansion can be improved.

The invention was made based on the foregoing findings and the invention can be summarized as follows.

An oil country tubular good according to the invention is expanded in a well. The oil country tubular good for expansion has a composition containing, in percentage by mass, 0.05% to 0.08% C, at most 0.50% Si, 0.80% to 1.30% Mn, at most 0.030% P, at most 0.020% S, 0.08% to 0.50% Cr, at most 0.01% N, 0.005% to 0.06% Al, at most 0.05% Ti, at most 0.50% Cu, and at most 0.50% Ni, and the balance consisting of Fe and impurities, and a structure including a ferrite ratio of at least 80%. The oil country tubular good further has a yield strength in the range from 276 MPa to 379 MPa and a uniform elongation of at least 16%. Herein, the ferrite ratio means a ferrite area ratio.

The chemical composition of the oil country tubular good for expansion according to the invention may contain, in place of part of Fe, one or more selected from the group consisting of at most 0.10% Mo, at most 0.10% V, at most 0.040% Nb, at most 0.005% Ca, and at most 0.01% of a rare metal element (REM).

The oil country tubular good for expansion preferably has a uniform elongation of at least 18%. The oil country tubular good for expansion is preferably quenched and then tempered at a tempering temperature of at least Ac1 point (at so-called two-phase region temperature).

Preferably, the ovality of the oil country tubular good for expansion according to the invention is at most 0.7% and the wall thickness eccentricity is at most 6.0%.

In this way, the collapse strength of the oil country tubular good for expansion is improved.

The oil country tubular good for expansion is preferably subjected to cold working, and then quenched and tempered. Here, the cold working is for example carried out by cold reduction.

In this way, while a uniform elongation of at least 16% is maintained, the ovality of the oil country tubular good for expansion is at most 0.7% and the wall thickness eccentricity is at most 6.0%.

A method of manufacturing an oil country tubular good for expansion according to the invention includes the steps of producing a hollow shell having a chemical composition containing, in percentage by mass, 0.05% to 0.08% C, at most 0.50% Si, 0.80% to 1.30% Mn, at most 0.030% P, at most 0.020% S, 0.08% to 0.50% Cr, at most 0.01% N, 0.005% to 0.06% Al, at most 0.05% Ti, at most 0.50% Cu, and at most 0.50% Ni, and the balance consisting of Fe and impurities, and quenching and tempering the produced hollow shell and making the hollow shell into an oil country tubular good for expansion having a ferrite ratio of at least 80%, a strength from 276 MPa to 379 MPa, and a uniform elongation of at least 16%.

Note that the chemical composition of the hollow shell may contain, in place of part of Fe, at least one of the above-described optional elements (Mo, V, Nb, Ca, and REM).

Preferably, in the quenching and tempering step, the quenched hollow shell is tempered at a tempering temperature of at least Ac1 point, so that the uniform elongation of the oil country tubular good for expansion is at least 18%.

Preferably, the method of manufacturing an oil country tubular good for expansion according to the invention further includes the step of subjecting the produced hollow shell to cold working, so that the ovality of the oil country tubular good for expansion is at most 0.7% and the wall thickness eccentricity is at most 6.0%. In the quenching and tempering step, the cold worked hollow shell is quenched and tempered.

BEST MODE FOR CARRYING OUT THE INVENTION

Figure 1:
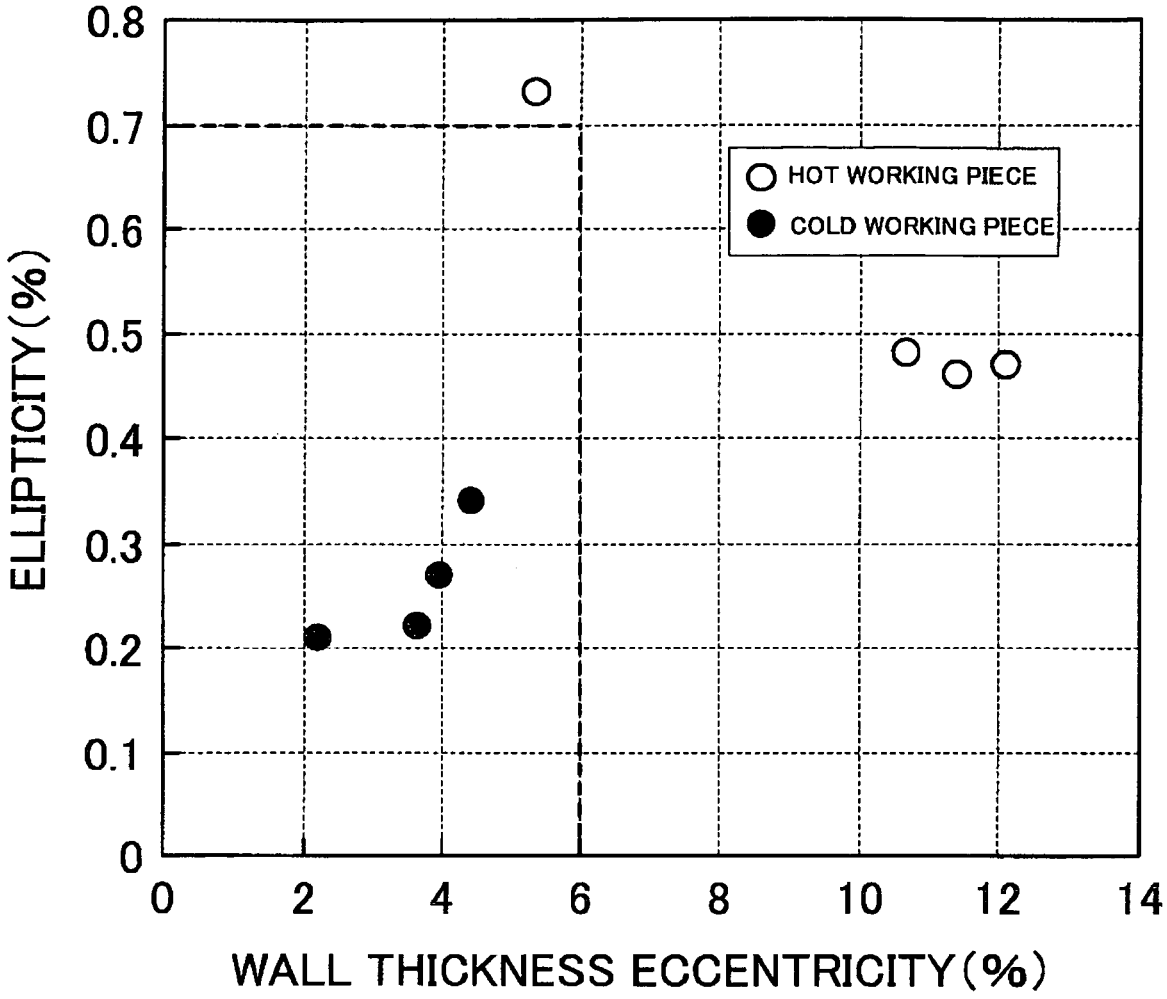
FIG. 1 is a graph showing the relation between the ovality and the wall thickness eccentricity of an oil country tubular good produced according to Example 2.

Now, embodiments of the invention will be described in detail. An oil country tubular good according to the invention contains the following chemical composition and metal structure. Hereinafter, "%" related elements stands for "% by mass."

1. Chemical Composition

C: 0.05% to 0.08%

Carbon (C) improves the strength of the steel. If the C content is less than 0.05%, yield strength necessary for the invention cannot be obtained. On the other hand, if the C content exceeds 0.08%, the uniform elongation is reduced. Therefore, the C content is in the range from 0.05% to 0.08%.

Si: 0.50% or less

Silicon (Si) deoxidizes the steel and also raises the tempering softening resistance to improve the strength of the steel. However, if the Si content exceeds 0.50%, the hot workability of the steel is degraded. Therefore, the Si content is 0.50% or less. In order to more effectively obtain the above-described effect, the Si content is preferably not less than 0.1%. However, if the Si content is less than 0.1%, the above-described effect is obtained to some extent.

Mn: 0.80% to 1.30%

Manganese (Mn) improves the hardenability of the steel and improves the strength of the steel. If the Mn content is less than 0.80%, yield strength necessary for the invention cannot be obtained. On the other hand, if the Mn content exceeds 1.30%, segregation in the steel increases and the toughness of the steel is degraded. Therefore, the Mn content is from 0.80% to 1.30%, preferably from 1.20% to 1.30%.

P: 0.030% or less

Phosphorus (P) is an impurity and lowers the toughness of the steel as it segregates at a grain boundary. Therefore, the P content is preferably as small as possible. Therefore, the P content is not more than 0.030%. The preferable P content is 0.015%.

S: 0.020% or less

Sulfur (S) is an impurity and combines with Mn or Ca to form an inclusion. The formed inclusion is elongated during hot working and lowers the toughness of the steel. Therefore, the S content is preferably as small as possible. Therefore, the S content is not more than 0.020%, preferably not more than 0.0050%.

Al: 0.005% to 0.06%

Aluminum (Al) deoxidizes the steel. If the Al content is less than 0.005%, the cleanliness of the steel is lowered because of insufficient deoxidizing and thus the toughness of the steel is lowered. On the other hand, if the Al content exceeds 0.06%, the toughness of the steel is also lowered. Therefore, the Al content is from 0.005% to 0.06%, preferably from 0.02% to 0.06%. Note that the Al content herein refers to the content of acid-soluble aluminum (sol. Al).

N: 0.01% or less

Nitrogen (N) is an impurity and combines with Al, Ti, or Nb to form a nitride. If a large amount of AlN or TiN precipitates, the toughness of the steel is lowered. Therefore, the N content is preferably as small as possible. Therefore, the N content is not more than 0.01%.

Cr: 0.08% to 0.50%

Chromium (Cr) improves the hardenability of the steel and Cr also improves the carbon dioxide corrosion resistance. If the Cr content is less than 0.08%, the carbon dioxide corrosion resistance is lowered. On the other hand, if the Cr content increases, coarse carbides are more easily formed and therefore the upper limit for the Cr content is 0.50%. Therefore, the Cr content is from 0.08% to 0.50%, preferably from 0.08% to 0.35%, more preferably from 0.08% to 0.25%.

Ti: 0.05% or less

Titanium (Ti) combines with N to form TiN and restrains crystal grains from being coarse in a high temperature range. If however the Ti content exceeds 0.05%, Ti combines with C to form TiC, which lowers the toughness of the steel. Therefore, the Ti content is 0.05% or less. Note that the effect of restraining crystal grains from being coarse is obtained to some extent if the Ti content is about 0.001% that is about as much as an impurity level, while the effect is more clearly indicated if the Ti content exceeds 0.005%.

Cu: 0.50% or less

Copper (Cu) improves the strength of the steel by solute strengthening. An excessive Cu content however embrittles the steel. If the Cu content exceeds 0.50%, the steel is significantly embrittled. Therefore, the Cu content is 0.50% or less. If the Cu content is not less than 0.01%, the above-described effect of improving the strength of the steel is clearly indicated.

Ni: 0.50% or less

Nickel (Ni) improves the toughness of the steel and restrains the embrittlement of the steel attributable to any coexisting Cu. If the Ni content exceeds 0.50% however, the effect reaches saturation. Therefore, the Ni content is 0.50% or less. The above-described effect is clearly indicated if the Ni content is not less than 0.01%.

Note that the balance of the chemical composition consists of Fe and impurities.

The oil country tubular good for expansion according to the invention contain Mo in place of part of Fe if necessary.

Mo: 0.10% or less

Molybdenum (Mo) is an optional additive element and Mo improves the hardenability to improve the strength of the steel. Molybdenum also restrains embrittlement caused by P or the like. However, an excessive Mo content causes a coarse carbide to form. Therefore, the Mo content is not more than 0.10%. The Mo content is preferably 0.05% for securing the above-described effect. If the Mo content is less than 0.05%, however, the above-described effect can be obtained to some extent.

The oil country tubular good for expansion according to the invention further contains one or more selected from the group consisting of Nb and V in place of part of Fe if necessary.

Nb: 0.040% or less

V: 0.10% or less

Niobium (Nb) and vanadium (V) are both optional additive elements. These elements both improve the strength of the steel. More specifically, Nb forms carbonitride and V forms carbide to improve the strength of the steel. However, an excessive Nb content causes segregation and elongated particles. An excessive V content lowers the toughness of the steel. Therefore, the Nb content is not more than 0.040% and the V content is not more than 0.10%. In order to effectively obtain the above-described effect, the Nb content is preferably not less than 0.001% and the V content is preferably not less than 0.02%. Note however that if the contents are less than the lower limits, the above-described effect can be obtained to some extent.

The oil country tubular good for expansion according to the invention contains one or more selected from the group consisting of Ca and a rare metal element (REM) in place of part of Fe if necessary.

Ca: 0.005% or less

REM: 0.01% or less

Calcium (Ca) and an REM are both optional additive elements. Calcium and an REM contribute to sulfide shape control and improve the toughness of the steel accordingly. However, if the Ca content exceeds 0.005% or the REM content exceeds 0.01%, a large amount of inclusion is generated. Therefore, the Ca content is not more than 0.005% and the REM content is not more than 0.01%. The Ca content is preferably not less than 0.001% and the REM content is preferably not less than 0.001% in order to effectively secure the above-described effect. However, if the Ca content and the REM content are less than the lower limits described above, the effect can be provided to some extent.

2. Metal Structure

The ferrite ratio in the metal structure is not less than 80%. Herein, the "ferrite ratio" means a ferrite area ratio measured by the following method. A sample is taken from an arbitrary position of an oil country tubular good for expansion. The sample is subjected to mechanical polishing, and the polished sample is etched in a 4% alcohol picrate solution. The etched surface of the sample is observed using an optical microscope and the ferrite ratio is measured by a point count method according to ASTM E562.

Note that in the metal structure, the part other than the ferrite phase includes a low temperature transformation phase. The low temperature transformation phase includes one or more of bainite, martensite, and pearlite.

It is considered that in the oil country tubular good for expansion according to the invention, a soft ferrite phase occupies a large percentage in the metal structure, and therefore at least 16% uniform elongation can be obtained. If the ferrite ratio is less than 80%, the ratio of the low temperature transformation phase harder than the ferrite phase increases, and therefore the uniform elongation is less than 16%.

3. Tensile Strength

The yield strength of the steel is in the range from 276 MPa to 379 MPa. Herein, the yield strength refers to the proof stress at 0.2% offset according to the ASTM standard. If the yield strength exceeds 379 MPa, the uniform elongation becomes less than 16%. On the other hand, if the yield strength is less than 276 MPa, strength necessary for an oil country tubular good cannot be obtained. Therefore, the yield strength is in the range from 276 MPa to 379 MPa.

4. Ovality and Wall Thickness Eccentricity

Preferably, in the oil country tubular good according to the invention, the ovality is not more than 0.7% and the wall thickness eccentricity is not more than 6.0%.

The ovality is defined by the following Expression (1):

$$\text{Ovality}(\%)=(\text{maximum outer diameter } D\text{max}-\text{minimum outer diameter } D\text{min})/\text{average outer diameter } D\text{ave}\times 100 \quad (1)$$

Herein, the maximum outer diameter Dmax, the minimum outer diameter Dmin, and the average outer diameter Dave are for example measured by the following method. In an arbitrary cross section of the oil country tubular good for expansion, the outer diameter of the same circle is measured at intervals of 22.5°. In this way, 16 (=360°/22.56) outer diameters are measured. Among the measured 16 outer diameters, the maximum outer diameter is defined as Dmax, and the minimum diameter as Dmin. The average of the measured 16 outer diameters is defined as the average Dave.

The wall thickness eccentricity is defined by the following Expression (2):

$$\text{Wall thickness eccentricity}(\%)=(\text{maximum wall thickness } T\text{max}-\text{minimum wall thickness } T\text{min})/\text{average wall thickness } T\text{ave}\times 100 \quad (2)$$

Herein, the maximum wall thickness Tmax, the minimum wall thickness Tmin, and the average wall thickness Tave are for example measured by the following method. In an arbitrary cross section of an oil country tubular good for expansion, the thickness is measured at intervals of 11.25°. In this way, 32 (360°/11.25°) thicknesses are measured. Among the 32 measured thicknesses, the maximum thickness is defined as Tmax and the minimum thickness as Tmin. The average of the measured 32 thicknesses is defined as Tave.

As will be described, a hollow shell after hot working is subjected to cold working before quenching and tempering, and an oil country tubular good for expansion having an ovality of 0.7% or less and a wall thickness eccentricity of 6.0% or less is obtained. Such an oil country tubular good for expansion has high geometrical homogeneity. Therefore, the tubular good has high collapse strength and high crush resistance. More preferably, the ovality is not more than 0.5% and the wall thickness eccentricity is not more than 5.0%.

Note that in the above example, the 16 outer diameters and the 32 thicknesses are measured, while as long as the same circumference is equally divided into eight or more and the outer diameter and the thickness are measured at each of the dividing points, the number of points for measuring is not particularly limited.

5. Manufacturing Method

An example of a method of manufacturing an oil country tubular good for expansion according to the invention will be described. Molten steel having the above-described chemical composition is cast and formed into billets. The produced billet is processed into a hollow shell (hollow shell producing process). In the hollow shell producing process, a hollow shell is produced by hot working. More specifically, the billet is pierced and rolled into a hollow shell. Alternatively, the billet may be formed into a hollow shell by hot extrusion.

The produced hollow shell is subjected to quenching and tempering and formed into an oil country tubular good for expansion according to the invention (quenching and tempering process). The quenching temperature is a well-known temperature (at least Ac3 point). On the other hand, the tempering temperature is preferably not less than Ac1 point. A specific process of preferable tempering is as follows. A hollow shell after quenching is raised in temperature to a tempering temperature equal to or higher than Ac1 point. After raising the temperature, the hollow shell is soaked for a prescribed period (for example about 30 minutes for a hollow shell having a thickness of 12.5 mm) at a tempering temperature. After the soaking, the hollow shell is cooled by air.

If the tempering temperature is not less than Ac1 point, the uniform elongation becomes 18% or more. Although the reason is not exactly known, it is probably because an austenite phase precipitates during the soaking when the tempering temperature is set to Ac1 point or higher, which refines crystal grains in the steel, so that the uniform elongation becomes 18% or more.

The upper limit for the tempering temperature is preferably Ac3 point. If the tempering temperature exceeds Ac3 point, the strength of the oil country tubular good for expansion is lowered. Therefore, the preferable tempering temperature is at least Ac1 point and less than Ac3 point.

Note that if the tempering temperature is less than Ac1 point, a uniform elongation of at least 16% can be obtained as long as the ferrite ratio is 80% or more and the yield strength is from 276 MPa to 379 MPa.

Ac1 and Ac3 points can be obtained by formastor testing. In the formastor testing, the thermal expansion of a specimen is measured using a transformation point measuring device (formastor) and transformation points (Ac1 and Ac3) are determined based on the measured thermal expansion.

Preferably, after the hollow shell manufacturing process and before the quenching and tempering process, cold working is carried out. In the cold working process, the produced hollow shell is subjected to cold working. The cold working is for example cold diameter reduction working, and more specifically is carried out by cold drawing or by cold rolling using a pilger mill. More preferably, the cold working is carried out by cold drawing. The ovality of the oil country tubular good for expansion becomes 0.7% or less and the wall thickness eccentricity becomes 6.0% or less by the cold working.

Note that before the cold working process, the hollow shell may be subjected to heat treatment such as quenching and tempering. The oil country tubular good for expansion produced by the above-described method is a seamless steel pipe, while the oil country tubular good for expansion according to the invention may be a welded pipe such as an electric resistance welded steel pipe. Note however that the welded pipe could suffer from a problem related to its corrosion resistance at the welded part, and therefore the oil country tubular good for expansion according to the invention is preferably a seamless steel pipe.

EXAMPLES

Example 1

A plurality of round billets having chemical compositions shown in Table 1 are produced.

TABLE 1

| steel | chemical composition (in % by mass, the balance consisting of Fe and impurities) | | | | | | | | | | | | | | Ac1 point |
|---|---|---|---|---|---|---|---|---|---|---|---|---|---|---|---|
| type | C | Si | Mn | P | S | Cu | Cr | Ni | Mo | V | Nb | Ti | N | Al | (° C.) |
| A | 0.07 | 0.28 | 1.32 | 0.008 | 0.0007 | 0.02 | 0.18 | 0.02 | 0.05 | 0.04 | — | 0.008 | 0.005 | 0.04 | 708 |
| B | 0.12 | 0.26 | 1.40 | 0.010 | 0.0023 | 0.29 | 0.11 | 0.42 | 0.01 | — | 0.027 | 0.024 | 0.006 | 0.04 | 715 |
| C | 0.06 | 0.21 | 1.24 | 0.008 | 0.0018 | 0.02 | 0.10 | 0.02 | — | — | — | 0.006 | 0.006 | 0.03 | 718 |

TABLE 1-continued

| steel | chemical composition (in % by mass, the balance consisting of Fe and impurities) | | | | | | | | | | | | | | Ac1 point |
|---|---|---|---|---|---|---|---|---|---|---|---|---|---|---|---|
| type | C | Si | Mn | P | S | Cu | Cr | Ni | Mo | V | Nb | Ti | N | Al | (° C.) |
| D | 0.17 | 0.28 | 1.39 | 0.014 | 0.0050 | 0.01 | 0.06 | 0.02 | 0.01 | 0.07 | — | 0.007 | 0.005 | 0.03 | 700 |
| E | 0.07 | 0.25 | 1.26 | 0.007 | 0.0015 | 0.02 | 0.09 | 0.02 | 0.01 | — | 0.001 | 0.009 | 0.001 | 0.04 | 729 |

With reference to Table 1, the chemical compositions of type C steel and type E steel were within the range defined by the invention. The Mn content of type A steel exceeded the upper limit defined by the invention. The C content and the Mn content of type B steel exceeded the upper limits defined by the invention. As for type D steel, the C content, the Mn content, and the Cr content were outside the ranges defined by the invention.

A specimen was taken from each of the round billets and formastor tests were carried out using the specimens, and the Ac1 point (° C.) of each of the steel types was obtained. The obtained points Ac1 are given in Table 1.

A plurality of round billets made from steel of each of types A to E were heated in a heating furnace. The heated round billets were pierced and rolled and a plurality of seamless pipes (hollow shells) were produced. The nominal outer diameter of each seamless pipe is 203.2 mm and the nominal wall thickness is 12.7 mm. The produced seamless steel pipes were subjected to quenching and tempering at the quenching temperature (° C.) and the tempering temperature (° C.) in Table 2 and oil country tubular goods for expansion were produced. The period for soaking was 30 minutes in the tempering process. The round billets with test Nos. 13 and 14 in Table 2 were subjected piercing and rolling and a plurality of seamless pipe each having a nominal outer diameter of 219.1 mm and a nominal wall thickness of 14.5 mm were produced. Then, produced seamless pipes were subjected to cold drawing with a reduction of area of 18.4% and made into seamless steel pipes each having a nominal outer diameter of 203.2 mm and a nominal wall thickness of 12.7 mm. The reduction of area was defined by following Expression (3)

$$\text{Reduction in area}(\%)=(\text{cross section of a seamless steel pipe before cold drawing}-\text{cross section of a seamless steel pipe after cold drawing})/(\text{cross section of a seamless steel pipe before cold drawing})\times 100 \quad (3)$$

Furthermore, the seamless steel pipes after cold drawing were subjected to quenching and tempering.

TABLE 2

| test No. | steel type | quenching temperature (° C.) | tempering temperature (° C.) | ferrite ratio (%) | YS (MPa) | TS (MPa) | uniform elongation (%) |
|---|---|---|---|---|---|---|---|
| 1 | A | 950 | 660 | 60 | 520 | 596 | 9.4 |
| 2 | A | 950 | 715 | 70 | 450 | 529 | 10.7 |
| 3 | A | 950 | 730 | 80 | 350 | 540 | 15.3 |
| 4 | B | 950 | 690 | 60 | 476 | 565 | 13.6 |
| 5 | B | 950 | 715 | 70 | 385 | 580 | 15.9 |
| 6 | B | 950 | 730 | 80 | 378 | 717 | 15.1 |
| 7 | C | 950 | 550 | 55 | 448 | 536 | 11.6 |
| 8 | C | 950 | 710 | 80 | 360 | 460 | 16.3 |
| 9 | C | 950 | 720 | 85 | 324 | 478 | 18.0 |
| 10 | C | 950 | 730 | 90 | 301 | 490 | 19.0 |
| 11 | D | 950 | 650 | 10 | 683 | 767 | 7.1 |
| 12 | D | 950 | 715 | 20 | 465 | 627 | 11.2 |
| 13 | E | 920 | 640 | 80 | 359 | 462 | 17.6 |
| 14 | E | 920 | 740 | 80 | 301 | 487 | 20.1 |

Measurement of Ferrite Ratio

The ferrite ratios of oil country tubular goods with test Nos. 1 to 14 shown in Table 2 were obtained by the following method. Specimens for structure observation were taken from the oil country tubular goods. The specimens were mechanically polished and the polished specimens were etched in a 4% alcohol picrate solution. The surfaces of the etched specimens were observed using an optical microscope (500×). At the time, the area of a region under observation was about 36000 $\mu m^2$. The ferrite ratio (%) was obtained in the observed region. The ferrite ratio was obtained by the point count method according to ASTM E562. The obtained ferrite ratios (%) are given in Table 2.

Tensile Testing

Tensile specimens were taken from oil country tubular goods for expansion with test Nos. 1 to 14 and tensile tests were carried out to them. More specifically, a round specimen having an outer diameter of 6.35 mm and a parallel part length of 25.4 mm was taken from each of the oil country tubular goods for expansion. The round specimens were subjected to tensile tests at room temperature. Yield strengths (MPa) obtained by the tensile tests are given in the "YS" column in Table 2, the tensile strengths (MPa) are given in the "TS" column in Table 2, the uniform elongations (%) are given in the "uniform elongation" column in Table 1. The 0.2% offset resistance according to the ASTM standard was defined as yield strength (YS). The distortion of each test piece at the maximum load point in a tensile test was defined as uniform elongation (%).

Test Result

With reference to Table 2, as for the oil country tubular goods with test Nos. 8 to 10, and 13 and 14, the chemical compositions, the metal structures (ferrite ratios), and the yield strengths were all within the ranges defined by the invention, and their uniform elongations were not less than 16%. Furthermore, as for the oil country tubular goods with test Nos. 9, 10, and 14, the tempering temperatures were not less than Ac1 point, and the uniform elongations were not less than 18%.

The piece with test No. 13 had an ovality of 0.22%, and a wall thickness eccentricity of 3.66%. The piece with test No. 14 had an ovality of 0.21% and a wall thickness eccentricity of 2.22%.

More specifically, the ovalities of those with test Nos. 13 and 14 were not more than 0.7% and their wall thickness eccentricities were not more than 6.0%. Note that the ovalities and wall thickness eccentricities were obtained by the method described in the above section 4.

On the other hand, the oil country tubular goods with test Nos. 1 to 3 had Mn contents exceeding the upper limit defined by the invention, and the uniform elongations were less than 16%. The oil country tubular good with test No. 3 in particular had a metal structure and a yield strength within the ranges defined by the invention, but the Mn content in the chemical composition was not within the range, and therefore the uniform elongation was less than 16%.

The oil country tubular goods with test Nos. 4 to 6, and 11 and 12 each had a chemical composition outside the range defined by the invention, and therefore their uniform elongations were less than 16%.

The oil country tubular good with test No. 7 had a chemical composition within the range defined by the invention but its ferrite ratio and yield strength were outside the ranges defined by the invention. Therefore, the uniform elongation was less than 16%.

Example 2

A plurality of oil country tubular goods for expansion were produced and the ovalities and the wall thickness eccentricities of the produced tubular goods were examined. More specifically, eight round billets having the chemical composition of type E steel in Table 1 were prepared. Four of the eight round billets were subjected to hot piercing and rolling and made into seamless steel pipes each having a nominal outer diameter of 203.2 mm and a nominal wall thickness of 12.7 mm. The produced seamless steel pipes were quenched at a quenching temperature of 950° C. After the quenching, the pipes were tempered at a tempering temperature of 650° C. and made into oil country tubular goods for expansion. Hereinafter, these four oil country tubular goods for expansion will be referred to as hot working pieces 1 to 4.

Meanwhile, the other four round billets were produced into oil country tubular goods for expansion by the following method. The billets were subjected to hot piercing and rolling and made into seamless steel pipes each having a nominal outer diameter of 219.1 mm and a nominal wall thickness of 14.5 mm. Then, the produced seamless steel pipes were subjected to cold drawing with a reduction of area of 18.4% and made into seamless steel pipes each having a nominal outer diameter of 203.2 mm and a nominal wall thickness of 12.7 mm. After cold drawing, the pipes were quenched at a quenching temperature of 920° C., then tempered at a tempering temperature from 640° C. to 740° C., and made into oil country tubular goods for expansion. Hereinafter, these oil country tubular goods for expansion will be referred to as cold working pieces 1 to 4.

The hot working pieces 1 to 4 and the cold working pieces 1 to 4 were measured for their ferrite ratios, yield strengths and uniform elongations similarly to Example 1. As a result, the hot working pieces and the cold working pieces all had a ferrite ratio of at least 80% and a yield strength from 276 MPa to 379 MPa. Their uniform elongations were all 16% or more.

The hot working pieces 1 to 4 and the cold working pieces 1 to 4 were also measured for their ovalities and wall thickness eccentricities. More specifically, 16 outer diameters were measured by the method described in section 4, and the maximum outer diameter Dmax, the minimum outer diameter Dmin, and the average outer diameter Dave were obtained. The ovalities were obtained using Expression (1). Thirty two wall thicknesses were measured by the method described in section 4, and the maximum wall thickness Tmax, the minimum wall thickness Tmin, and the average wall thickness Tave were obtained. Their wall thickness eccentricities were obtained using Expression (2). The result of examination is given in Table 3 and FIG. 1. In FIG. 1, "○" represents a hot working piece and "●" represents a cold working piece.

TABLE 3

| test piece | steel type | ovality (%) | wall thickness eccentricity (%) |
|---|---|---|---|
| hot working piece 1 | E | 0.73 | 5.38 |
| hot working piece 2 | E | 0.48 | 10.67 |
| hot working piece 3 | E | 0.47 | 12.11 |
| hot working piece 4 | E | 0.46 | 11.39 |
| cold working piece 1 | E | 0.22 | 3.66 |
| cold working piece 2 | E | 0.21 | 2.22 |
| cold working piece 3 | E | 0.27 | 3.96 |
| cold working piece 4 | E | 0.34 | 4.43 |

With reference to Table 3 and FIG. 1, the ovalities of the cold working pieces 1 to 4 were smaller than those of the hot working pieces 1 to 4 and not more than 0.7%. The wall thickness eccentricities of the cold working pieces 1 to 4 were smaller than those of the hot working pieces 1 to 4 and not more than 6.0%.

Although the embodiments of the present invention have been described and illustrated in detail, it is clearly understood that the same is by way of illustration and example only of how to carry out the invention and is not to be taken by way of limitation. The invention may be embodied in various modified forms without departing from the spirit and scope of the invention.

INDUSTRIAL APPLICABILITY

The oil country tubular good for expansion according to the invention is widely applicable as an oil country tubular good and is particularly applicable as an oil country tubular good to be expanded in a well.

The invention claimed is:

1. An oil country tubular good for expansion in a well having a composition comprising, in percentage by mass, 0.05% to 0.08% C, at most 0.50% Si, 0.80% to 1.30% Mn, at most 0.030% P, at most 0.020% S, 0.08% to 0.50% Cr, at most 0.01% N, 0.005% to 0.06% Al, at most 0.05% Ti, at most 0.50% Cu, and at most 0.50% Ni, and the balance consisting of Fe and impurities, a quenched and tempered structure comprising a ferrite ratio of at least 80% and a yield strength in the range from 276 MPa to 379 MPa, wherein the oil country tubular good for expansion has a uniform elongation of at least 18%.

2. An oil country tubular good for expansion in a well having a composition comprising, in percentage by mass, 0.05% to 0.08% C, at most 0.50% Si, 0.80% to 1.30% Mn, at most 0.030% P, at most 0.020% S, 0.08% to 0.50% Cr, at most 0.01% N, 0.005% to 0.06% Al, at most 0.05% Ti, at most 0.50% Cu, and at most 0.50% Ni, and the balance consisting of Fe and impurities, a quenched and tempered structure comprising a ferrite ratio of at least 80% and a yield strength in the range from 276 MPa to 379 MPa, wherein said composition contains, in place of part of said Fe, one or more selected from the group consisting of at most 0.10% Mo, at most 0.10% V, at most 0.040% Nb, at most 0.005% Ca, and at most 0.01% of a rare metal element, and further wherein the oil country tubular good for expansion has a uniform elongation of at least 18%.

3. The oil country tubular good for expansion according to claim 1 being quenched and then tempered at a tempering temperature of at least Ac1 point.

4. The oil country tubular good for expansion according to claim 2 being quenched and then tempered at a tempering temperature of at least Ac1 point.

5. The oil country tubular good for expansion according to claim 1 further having an ovality of at most 0.7% and a wall thickness eccentricity of at most 6.0%.

6. The oil country tubular good for expansion according to claim 2 further having an ovality of at most 0.7% and a wall thickness eccentricity of at most 6.0%.

7. The oil country tubular good for expansion according to claim 3 further having an ovality of at most 0.7% and a wall thickness eccentricity of at most 6.0%.

8. The oil country tubular good for expansion according to claim 4 further having an ovality of at most 0.7% and a wall thickness eccentricity of at most 6.0%.

9. A method of manufacturing an oil country tubular good for expansion, comprising the steps of:

producing a hollow shell having a composition comprising, in percentage by mass, 0.05% to 0.08% C, at most 0.50% Si, 0.80% to 1.30% Mn, at most 0.030% P, at most 0.020% S, 0.08% to 0.50% Cr, at most 0.01% N, 0.005% to 0.06% Al, at most 0.05% Ti, at most 0.50% Cu, and at most 0.50% Ni, and the balance consisting of Fe and impurities; and quenching and tempering said produced hollow shell and making the hollow shell into an oil country tubular good for expansion having a ferrite ratio of at least 80% and a yield strength from 276 MPa to 379 MPa wherein in said quenching and tempering step, said quenched hollow shell is tempered at a tempering temperature of at least Ac1 point, so that the uniform elongation of said oil country tubular good for expansion is at least 18%.

10. A method of manufacturing an oil country tubular good for expansion, comprising the steps of:

producing a hollow shell having a composition comprising, in percentage by mass, 0.05% to 0.08% C, at most 0.50% Si, 0.80% to 1.30% Mn, at most 0.030% P, at most 0.020% S, 0.08% to 0.50% Cr, at most 0.01% N, 0.005% to 0.06% Al, at most 0.05% Ti, at most 0.50% Cu, and at most 0.50% Ni, and the balance consisting of Fe and impurities; and quenching and tempering said produced hollow shell and making the hollow shell into an oil country tubular good for expansion having a ferrite ratio of at least 80% and a yield strength from 276 MPa to 379 MPa, wherein the composition of said hollow shell contains, in place of part of said Fe, one or more selected from the group consisting of at most 0.10% Mo, at most 0.10% V, at most 0.040% Nb, at most 0.005% Ca, and at most 0.01% of a rare metal element, and further wherein in said quenching and tempering step, said quenched hollow shell is tempered at a tempering temperature of at least Ac1 point, so that the uniform elongation of said oil country tubular good for expansion is at least 18%.

11. The method of manufacturing an oil country tubular good according to claim 9, further comprising the step of subjecting said produced hollow shell to cold working, so that the ovality of said oil country tubular good for expansion is at most 0.7% and the wall thickness eccentricity is at most 6.0%, wherein in said quenching and tempering step, said cold worked hollow shell is quenched and tempered.

12. The method of manufacturing an oil country tubular good according to claim 10, further comprising the step of subjecting said produced hollow shell to cold working, so that the ovality of said oil country tubular good for expansion is at most 0.7% and the wall thickness eccentricity is at most 6.0%, wherein in said quenching and tempering step, said cold worked hollow shell is quenched and tempered.

* * * * *